US005727600A

United States Patent [19]

Musha et al.

[11] Patent Number: 5,727,600

[45] Date of Patent: Mar. 17, 1998

[54] HEALD THREADING METHOD FOR GROUPING WARP YARNS IN A 1/F FLUCTUATION

[75] Inventors: Toshimitsu Musha, 13-17, Minami-Tsukushino 2-chome, Machida-shi, Tokyo; Yuichi Yanai, Okazaki; Shoji Takagi, Okazaki; Shu Ono, Okazaki, all of Japan

[73] Assignees: Nisshinbo Industries Inc.; Toshimitsu Musha, both of Tokyo, Japan

[21] Appl. No.: 646,951

[22] Filed: May 8, 1996

[30] Foreign Application Priority Data

May 10, 1995 [JP] Japan ..... 7-136188

[51] Int. Cl.[6] ..... D03D 13/00; D03D 23/00

[52] U.S. Cl. ..... 139/55.1; 139/383 R; 139/416

[58] Field of Search ..... 364/140; 139/55.1, 139/383 R, 416

[56] References Cited

U.S. PATENT DOCUMENTS

| | | | |
|---|---|---|---|
| 416,225 | 12/1889 | Kerr | 139/416 |
| 3,696,845 | 10/1972 | Acker et al. | 139/417 |
| 4,497,570 | 2/1985 | Nagoka et al. | 354/403 |
| 5,243,267 | 9/1993 | Ogasawara | 318/590 |
| 5,396,413 | 3/1995 | Kaneko et al. | 364/140 |

FOREIGN PATENT DOCUMENTS

| | | | |
|---|---|---|---|
| 0049105 | 4/1982 | European Pat. Off. | 139/383 R |
| 1324430 | 3/1963 | France | 139/383 R |
| 0088153 | 5/1985 | Japan | 139/383 R |
| 2156335 | 7/1987 | Japan | 139/383 R |
| 3235544 | 9/1988 | Japan | 139/383 R |

OTHER PUBLICATIONS

"Bioinformation and 1/f Fluctuation", applied Physics, 1985, pp. 429–435. (Which corresponds to partial translation, Physics Of The Living State, Ohmasha, 1994).

"Biocontrol and /1f Fluctuation" Journal of Japan Society of Precision Machinery, 1984, vol. 50 No. 6. (Which corresponds to partial translation, Computer Analysis of cardiovascular signals Chapter 6 1/f fluctuations of the Biological Rhythm, 1/f *Fluctuations of the Biological Rhythm*, IOS Press, 1995).

"The World of Fluctuations" by Kodansha Publisher (Which corresponds to partial translation, 1/f–Like fluctuations of Biological Rhythm, Musha, Brain Functions Laboratory, Japan) no date supplied.

"Seitai Shingo, Chapter 10, Biological Rhythm", Chapter 10, with a translation of section 2–4 in Chapter 10, (partial translation of Seitai Shingo, section 2–4 in Chapter 10), (Which corresponds to partial translation, Biological Signals—Actual Measurement and Analysis—, Corona Publishing Co., Ltd.) No Date Supplied.

*Primary Examiner*—Andy Falik

*Attorney, Agent, or Firm*—Nikaido, Marmelstein, Murray & Oram LLP

[57] ABSTRACT

A weaving method that imparts a correlation of a 1/f fluctuation to the texture pattern of a woven fabric by passing warp yarns through a plural number of healds in a specific numerical sequence. The healds are then manipulated to separate the warp yarns into two sets to form a shed therebetween through which a weft yarn is inserted. For one texture pattern, warp yarns are threaded in groups in numbers corresponding to the values of a numerical sequence with a 1/f fluctuation through one set of healds. For another texture pattern, warp yarns are threaded in groups through another set of healds so as to alternate with the first groups, thereby weaving a plural number of texture patterns into the woven goods, with the overall texture design having a 1/f fluctuation.

4 Claims, 6 Drawing Sheets

TWILL
LEFT WEAVE

TWILL
RIGHT WEAVE

HEALD THREADING METHOD FOR GROUPING WARP YARNS IN A 1/F FLUCTUATION

BACKGROUND OF THE INVENTION

This invention relates to a weaving method designed to obtain a textured pattern comprised of a combination of a number of different types of texture designs.

In conventional weaving methods, a large number of warp yarns are threaded through a multiple number of healds and reed dents in a parallel array. Thereafter, while the healds are moved up and down in accordance with the texture design, the warp yarns are separated into two sets and the weft yarns are passed through the shed formed between the two sets to produce a given warp and weft texture. A number of different types of texture designs are utilized in the heald operation to weave the texture pattern into the fabric.

Conventional textured patterns are of uniform design, and therefor do not have a natural, irregular feel. The goods instead have an artificial texture with very little natural feel and are not particularly comfortable for the wearer.

The present inventor, Toshimitsu Musha, was the first in the world to discover that a 1/f fluctuation would impart a particularly comfortable feel to humans. The results were published in "The World of Fluctuations", released by Kodansha Publishers in 1980; and were also announced in a paper entitled "Bioinformation and 1/f Fluctuation", *Applied Physics,* 1984, pp 429–435, and another paper titled "Biocontrol and 1/f Fluctuation", *Journal of Japan. Soc. of Precision Machinery,* 1984, vol 50, No. 6, as well as in a recent publication called "the Concept of Fluctuations", published by NHK in 1994. The abstract of these publications read, > [t]he 1/f fluctuation provides a comfortable feeling to humans; the reason being that the variations in the basic rhythm of the human body have a 1/f spectrum. From another perspective, the human body eventually tires of a constant stimulation from the same source, but conversely, the body feels uncomfortable if the stimulations were to change too suddenly; therefore a 1/f fluctuation is a fluctuation of the right proportion between these two extremes.

An excerpt from "The World of Fluctuations", published by Kodansha Publishers, reads > For example, the rhythms exhibited by the human body such as heart beats, and hand-clapping to music, impulse-release period of neurons, and α-rhythms observed in the brain, are all basically 1/f fluctuations, and it has been shown experimentally that if a body is stimulated by a fluctuation like these biorhythmic 1/f fluctuations, it would feel comfortable.

Fluctuations (variations) exist in various forms throughout nature, but the murmur of a brook, a breath of wind, and other phenomena that impart a comfortable feeling to humans have a 1/f fluctuation, while typhoons and other strong winds that impart uneasiness do not have a 1/f fluctuation.

The present invention overcomes the above noted problems with conventional weaving methods and provides a weaving method that imparts a correlation of a 1/f fluctuation to the texture pattern of a woven fabric.

DETAILED DESCRIPTION AND OBJECTIVES OF THE INVENTION

An objective of this invention is to make woven goods available that provide a natural, comfortable feel to the wearer. A second objective of this invention is to provide a weaving method which causes the pattern obtained by combining different types of textures to have a correlation, specifically, a 1/f fluctuation. A third objective of this invention is to provide a method to produce woven goods with a natural, irregular feel on an industrial scale.

In this invention, "1/f fluctuation" is defined as a power spectrum, with a frequency component f, and proportional to $1/f^k$, where k is approximately 1, and similar spectra thereof.

The present invention provides a weaving method for weaving woven goods from warp yarns and weft yarns in which warp yarns are threaded through a multiple number of healds, the warp yarns are separated into two sets to form a shed between the two sets, and the weft yarn is passed through the shed; wherein the processes are performed in such a manner that the multiple texture patterns obtained therein vary so as to have a 1/f fluctuation.

The present invention also provides a weaving method for weaving woven goods from warp yarns and weft yarns in which warp yarns are threaded through a multiple number of healds, the warp yarns are separated into two sets to form a shed between the two sets, and the weft yarn is passed through the shed; wherein for one texture pattern, warp yarns are threaded in groups in number corresponding of the values of a numerical sequence with a 1/f fluctuation through one set of healds, and for another texture pattern, warp yarns are threaded in groups through another set of healds so as to alternate with the first groups, thereby weaving a plural number of texture patterns into the woven goods, with the overall texture design having a 1/f fluctuation.

Another embodiment of the present invention is a weaving method for weaving goods from warp yarns and weft yarns in which warp yarns are passed through a multiple number of healds, the warp yarns are separated into two sets to form a shed between the two sets, and the weft yarn is passed through the shed; wherein for one texture pattern, warp yarns are threaded in groups in numbers corresponding to every other value of a numerical sequence with a 1/f fluctuation through one set of healds, and for another texture pattern, warp yarns are threaded in groups in numbers corresponding to the alternate values of the numerical sequence through another set of healds so as to alternate with the first groups, thereby weaving a multiple number of texture patterns into the woven goods, with the overall texture design having a 1/f fluctuation.

A further embodiment of the invention is a weaving method for weaving woven goods from warp yarns and weft yarns in which warp yarns are passed through a multiple number of healds, the warp yarns are separated into two sets to form a shed between the two sets, and the weft yarn is passed through the shed; wherein for one texture pattern, warp yarns are threaded in groups in numbers corresponding to the values of a numerical sequence with a 1/f fluctuation through one set of healds, and for another texture pattern, warp yarns are threading groups in number corresponding to the values of another numerical sequence with a 1/f fluctuation through another set of healds so as to alternate with the first groups, thereby weaving a plural number of texture patterns into the woven goods, with the overall texture design having a 1/f fluctuation.

The present invention offers the following advantages:

1. The texture pattern of the woven fabric does not change randomly; rather, it has a correlation, and because this correlation has a 1/f fluctuation, it imparts a special feeling of comfort and aesthetic beauty to the wearer.

2. Woven goods with a hand-woven natural irregular feel can be manufactured at low cost on an industrial scale.

3. Incorporating the variations in strength of a sound, melody, or gentle breeze having a 1/f fluctuation into woven goods can evoke a feeling of comfort for the wearer.

SIMPLIFIED EXPLANATION OF DIAGRAMS

The above and other objects and the attendant advantages of the present invention will become readily apparent by reference to the following detailed description when considered in conjunction with the accompanying drawings wherein.

Figure 4A:
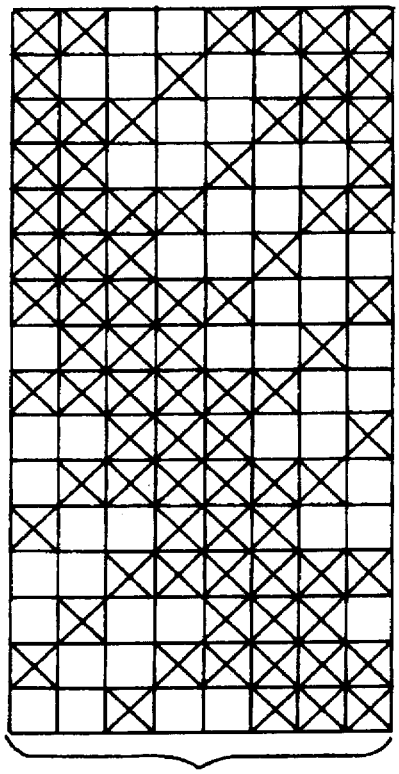
Figure 4B:
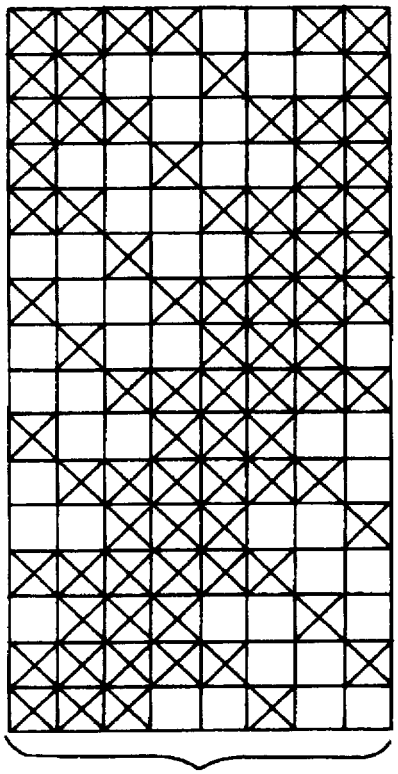
Figure 5:
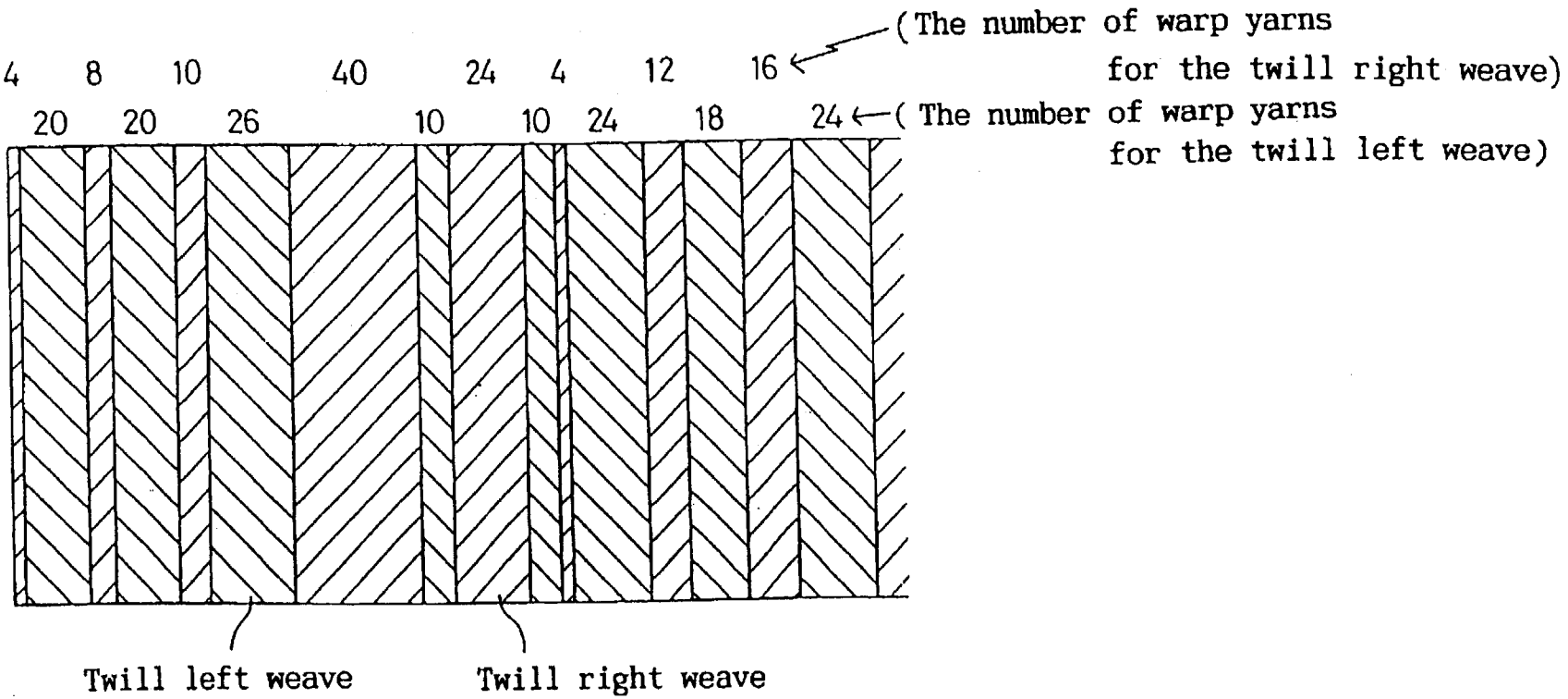
Figure 6:
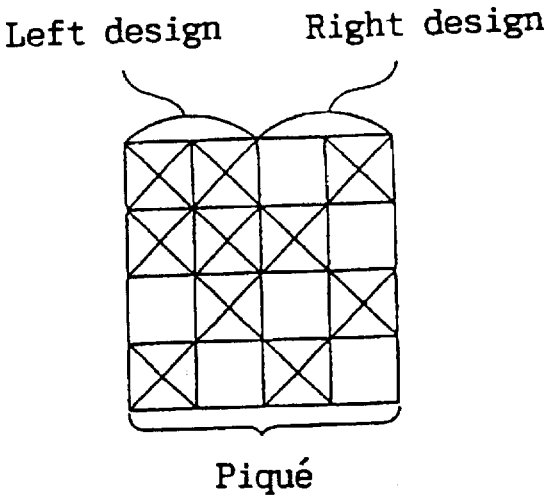

FIGS. 4(A) and 4(B) illustrate alternate twill textures;

FIG. 5 illustrates a twill pattern with a 1/f fluctuation;

FIG. 6 illustrates a pique texture; and

Figure 7:
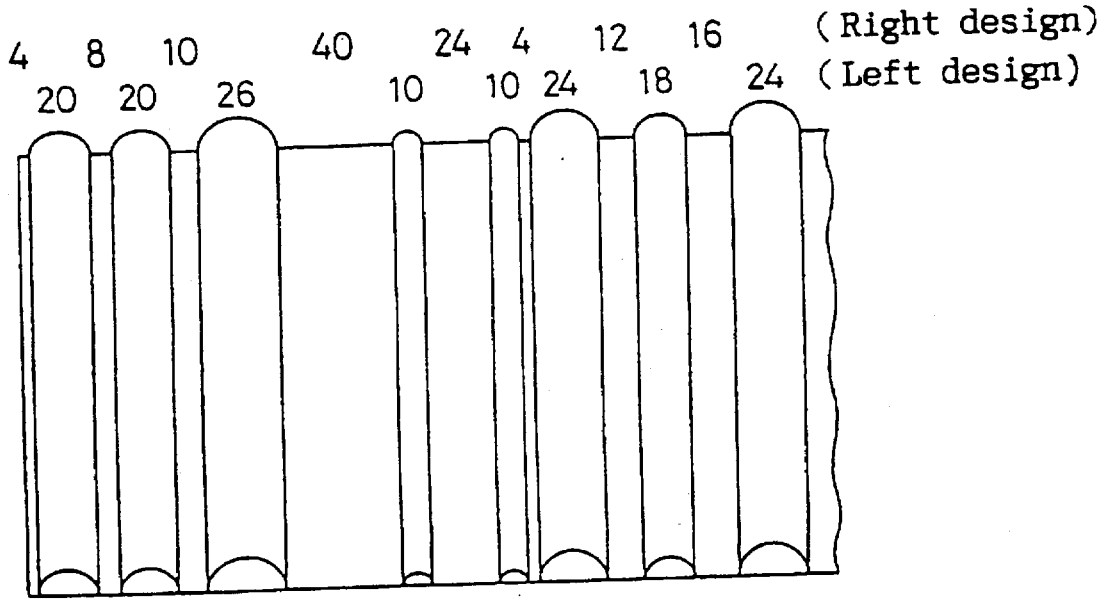

FIG. 7 illustrates a pique pattern with a 1/f fluctuation.

DETAILED DESCRIPTION OF THE INVENTION AND OF THE PREFERRED EMBODIMENT

1. Overview of the weaving machine

Figure 1:
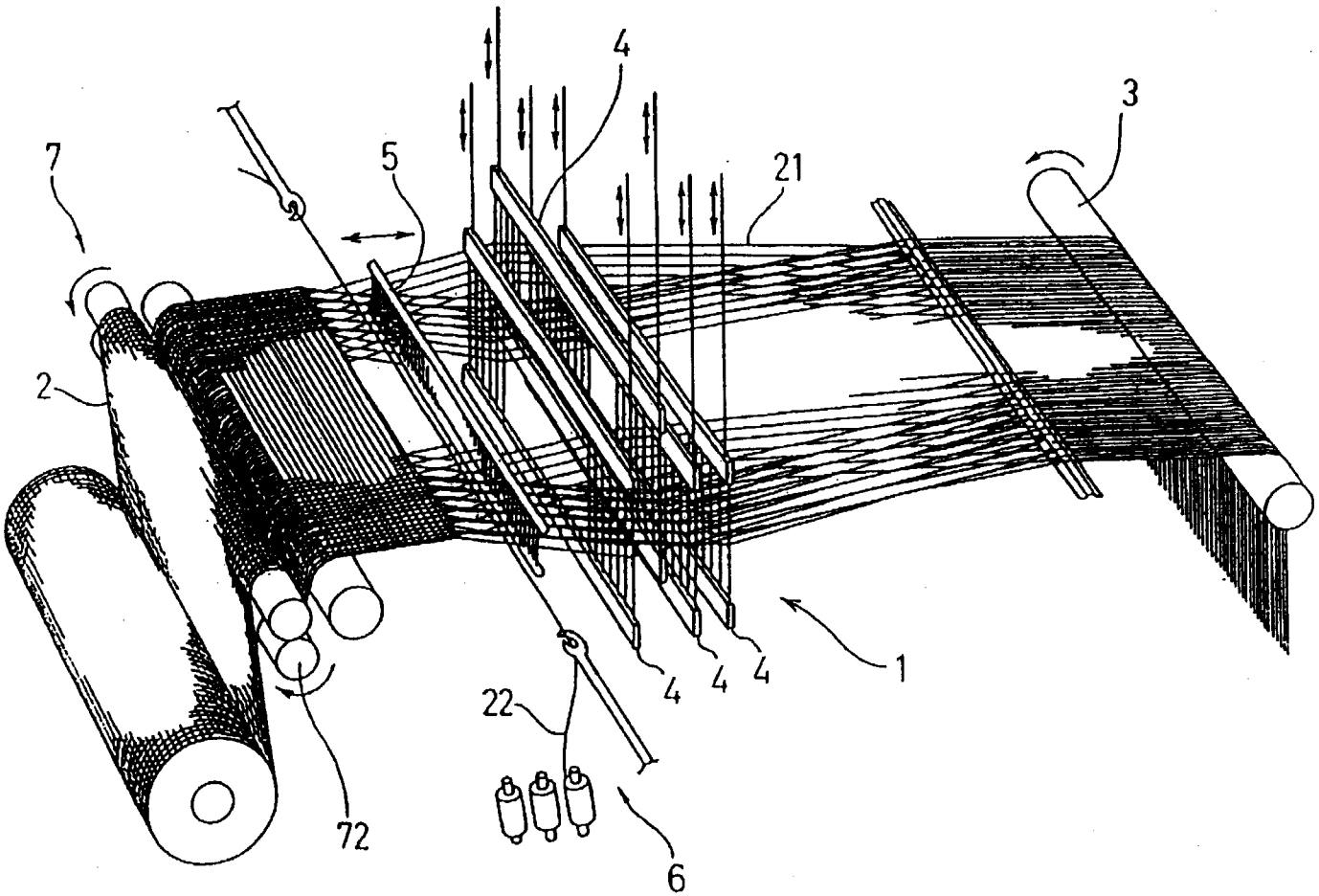
FIG. 1 is an overview of the principal components of a weaving machine.

Weaving machine 1 weaves spun yarn into woven goods 2 through the primary movements of opening a shed, inserting the weft yarn, and beating the weft yarn, and the secondary movements of letting off warp yarns 21 and taking up the woven goods 2. An example is shown in FIG. 1. The action of opening the shed divides all the warp yarns into two sets, forming an opening through which the weft yarn 22 passes, thereby enabling warp yarns 21 and weft yarn 22 to cross over each other. For this purpose, warp yarns 21 are drawn-in through a multiple number of healds 4 in a prescribed order, and the up and down action of these healds 4 separates the warp yarns 21 vertically. The weave so obtained can be changed into a plain weave, twill weave, satin weave, or other type of texture by varying the manner in which the warp yarns 21 are divided into two sets.

In one method of weft insertion, the weft yarn is wound around a wooden tube that is inserted into a rapier 6 which $$y_j = x_j + \left(\frac{1}{2}\right) x_{j-1} + \left(\frac{1*3}{2^2*2!}\right) x_{j-2} + \left(\frac{1*3*5}{2^3*3!}\right) x_{j-3} + \ldots \left(\frac{1*3*5*\ldots*(2n-1)}{2^{n-1}*(n-1)!}\right) x_{j-n+1} \quad (1)$$

The sequence of numerical values having a 1/f fluctuation may be obtained in two steps. In step 1, a computer, for example, generates a sequence of random numbers, x. In step 2, a certain number, n, of coefficients, a, stored in a storage device, are successively multiplied on the random numbers, and then a sequence of numerical values, y, is obtained by a linear transformation. This numerical sequence, y, has a 1/f spectrum, and can be used as a sequence of numerical values having a 1/f fluctuation. Three examples of numerical sequences with a 1/f fluctuation so obtained are shown below. Other numerical sequences with a 1/f fluctuation can be derived, for example, from a sound, melody, or a breath of wind, the strengths of which varies with a 1/f fluctuation.

Numerical sequence 1=32, 18, 24, 14, 10, 20, 16, 16, 12, 4, 14, 16, 16, 8, 24, 4, 10, 28, 28, 12, 10, 2, 2, . . .

Numerical sequence 2=4, 8, 10, 40, 24, 4, 12, 16, 20, 16, 24, 8, 8, 14, 14, 22, 26, 4, 8, 14, 14, 26, 28, . . .

Numerical sequence 3=20, 20, 26, 10, 10, 24, 18, 24, 12, 6, 12, 16, 16, 10, 24, 6, 12, 32, 12, 12, . . .

Weaving methods to produce textured patterns with a 1/f fluctuations are discussed next.

4. Weaving of combined plain weave and satin weave texture

This example illustrates a weaving method to impart a 1/f fluctuation to a texture pattern of a combined plain weave and satin weave. For this, No. 105-count two-fold yarn is used for both the warp and weft yarns in a shuttle weaving machine equipped with for example, 12 healds.

Figure 2:
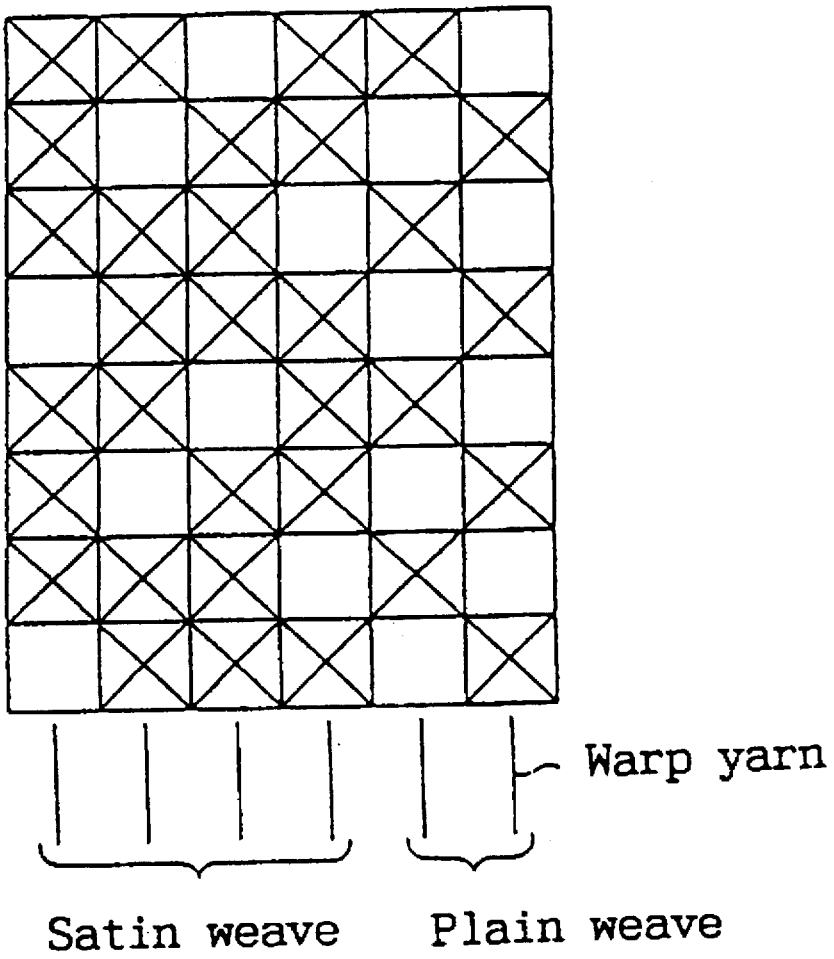
FIG. 2 illustrates a combined plain weave and satin weave texture.
Figure 3:
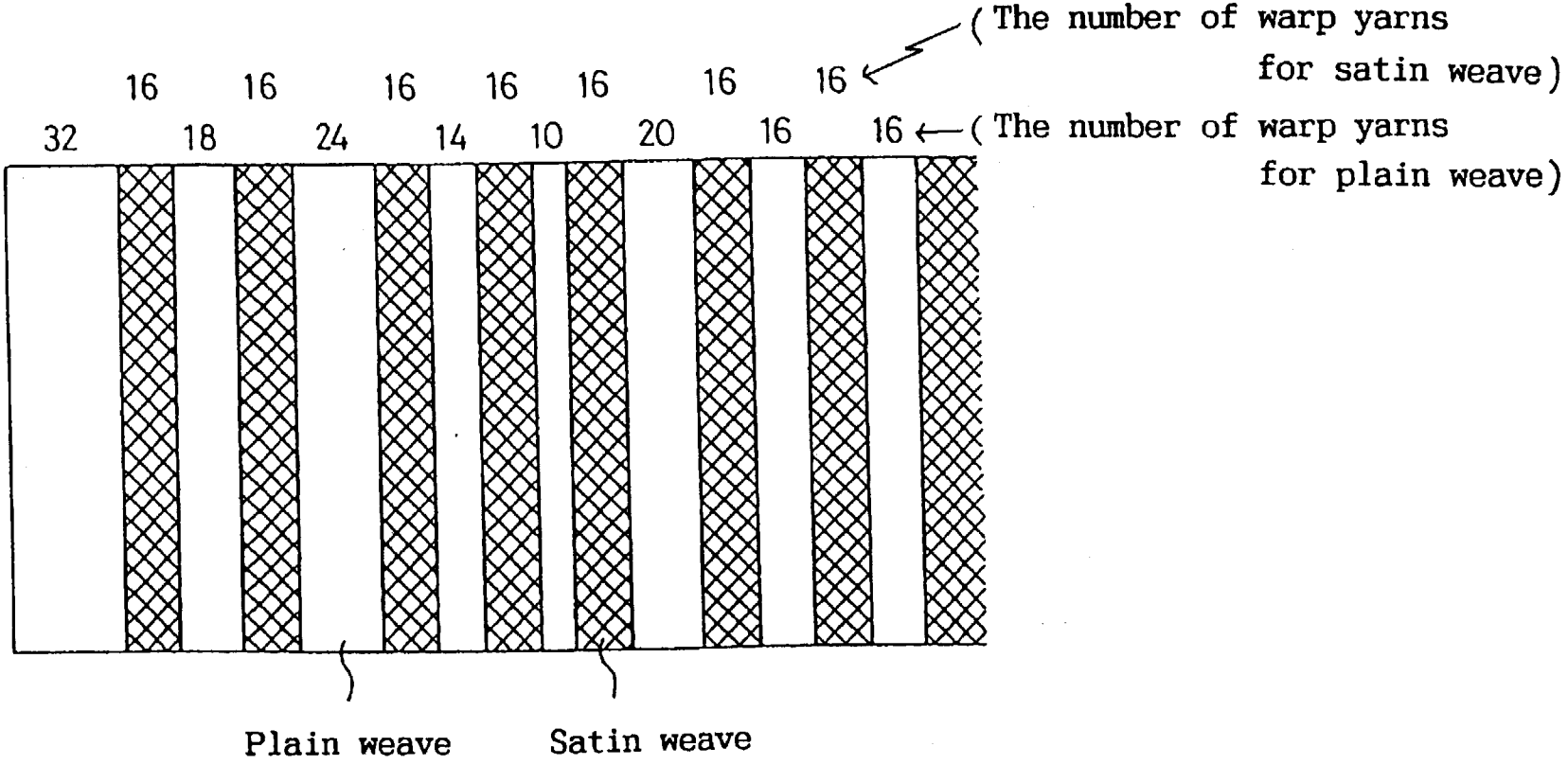
FIG. 3 illustrates a combined plain weave and satin pattern with a 1/f fluctuation.

A texture pattern of a combined plain weave and satin weave is illustrated in FIG. 2; here the four columns to the left are a satin weave, and the two columns to the right are a plain weave. By controlling the vertical movement of the 12 healds, a satin weave can be obtained by repeating the design of the two right columns. The "X" marks the diagram indicating that the warp yarns are on top of the weft yarns.

To obtain a combined plain weave and satin weave texture with a 1/f fluctuation, plain weaving and satin weaving are alternated, in which for example, the number of plain weave columns are changed in accordance with numerical sequence 1 (32, 18, . . .) as described above, while the patterns can be obtained by controlling the up and down movement of the 8 healds in accordance with these respective twill designs.

To obtain a combined twill right and twill left texture with a 1/f fluctuation, for example, the values of numerical sequence 2 (4, 8, . . .) are used for the twill right weave, while the values of numerical sequence 3 (20, 20, . . .) are used for the twill left weave. That is, 4 warp yarns are arranged in the healds so as to produce the twill right pattern of FIG. 4(B), the next 20 warp yarns are arranged in the healds so as to produce the twill left pattern of FIG. 4(A), the next 8 yarns are arranged in the twill right healds, the next 20 yarns are arranged in the twill left healds. This arrangement of warp yarns is continued in this manner to weave two types of twill patterns. A twill texture pattern so obtained by this method has a 1/f fluctuation as shown in FIG. 5.

6. Changing rib width of pique fabric

This example illustrates a pique texture using No. 105-count two-fold yarn for both the warp and weft yarns in a shuttle weaving machine equipped with for example, 8 healds. FIG. 6 illustrates a pique texture design, indicating the crossover state of the warp and weft yarns. In one example to obtain a pique texture with a 1/f fluctuation, the up and down movement of the 8 healds is controlled in accordance with the design of the two right columns and the two left columns of FIG. 6.

For example, numerical sequence 2 is used for the right design, while numerical sequence 3 is used for the left design of FIG. 6. That is, 4 warp yarns (numerical sequence 2) are allocated for the right design, then 20 yarns (numerical sequence 3) for the left design, then 8 yarns for the right design, then 20 yarns for the left design, then 10 yarns for the right design, then 26 yarns for the left design and so forth. The pique texture so obtained has a 1/f fluctuation as shown in FIG. 7.

It is readily apparent that the above-described has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

We claim:

1. A weaving method for weaving woven goods with a 1/f fluctuation from warp yarns and weft yarns comprising:

threading warp yarns through a multiple number of healds in patterns according to at least one sequence with a 1/f fluctuation;

separating the warp yarns into two sets to form a shed between the two sets by lifting and lowering of said healds;

passing a weft yarn through the shed in such a manner that the multiple texture patterns obtained therein vary so as to have a 1/f fluctuation.

2. A weaving method for weaving woven goods with a 1/f fluctuation from warp yarns and weft yarns comprising:

threading warp yarns through a multiple number of healds wherein for a first texture pattern, warp yarns are threaded in groups in numbers corresponding to the values of a numerical sequence with a 1/f fluctuation through one set of healds, and for a second texture pattern, warp yarns are threaded in groups in numbers corresponding to alternate values of said numerical sequence through another set of healds so as to alternate with said first groups, thereby weaving a plural number of texture patterns into the woven goods, with the overall texture design having a 1/f fluctuation;

separating the warp yarns into two sets to form a shed between the two sets by lifting and lowering of said healds; and passing a weft yarn through the shed.

3. A weaving method for weaving woven goods with a 1/f fluctuation from warp yarns and weft yarns comprising:

threading warp yarns through a multiple number of healds, wherein for a first texture pattern, warp yarns are threaded in groups in number corresponding to every other value of a numerical sequence with a 1/f fluctuation through one set of healds, and for a second texture pattern, warp yarns are threaded in groups in numbers corresponding to alternate values of the numerical sequence through another set of healds so as to alternate with the first groups;

separating the warp yarns into two sets to form a shed between the two sets by lifting and lowering of said healds;

passing a weft yarn through the shed thereby weaving a plural number of texture patterns into the woven goods, with the overall texture design having a 1/f fluctuation.

4. A weaving method for weaving woven goods with a 1/f fluctuation from warp yarns and weft yarns comprising:

threading warp yarns through a multiple number of healds, wherein for a first texture pattern, warp yarns are threaded in groups in numbers corresponding to the values of a first numerical sequence with a 1/f fluctuation through one set of healds, and for a second texture pattern, warp yarns are threaded in groups in numbers corresponding to the values of a second numerical sequence with a 1/f fluctuation through another set of healds so as to alternate with the first groups;

separating the warp yarns into two sets to form a shed between the two sets by lifting and lowering of said healds;

passing a weft yarn through the shed, thereby weaving a plural number of texture patterns into the woven goods, with the overall texture design having a 1/f fluctuation.

* * * * *